US011538614B2

(12) United States Patent
Ndiaye et al.

(10) Patent No.: US 11,538,614 B2
(45) Date of Patent: Dec. 27, 2022

(54) FLEXIBLE TRANSFORMER SYSTEM

(71) Applicant: General Electric Company, Schenectady, NY (US)

(72) Inventors: Ibrahima Ndiaye, Ballston Spa, NY (US); Omar Mendez-Zamora, San Nicolas de los Garza (MX); Enrique Betancourt-Ramirez, Monterrey (MX); Ahmed Elasser, Latham, NY (US); Jovan Z. Bebic, Clifton Park, NY (US); Yazhou Jiang, Niskayuna, NY (US); Jesus Avila-Montes, Apodaca (MX)

(73) Assignee: General Electric Technology Gmbh, Baden (CH)

( * ) Notice: Subject to any disclaimer, the term of this patent is extended or adjusted under 35 U.S.C. 154(b) by 261 days.

(21) Appl. No.: 16/689,438

(22) Filed: Nov. 20, 2019

(65) Prior Publication Data

US 2021/0151235 A1 May 20, 2021

(51) Int. Cl.
*H05B 6/04* (2006.01)
*H05B 6/02* (2006.01)
(Continued)

(52) U.S. Cl.
CPC ..... *H01F 27/004* (2013.01); *G05F 1/455* (2013.01); *G05F 5/00* (2013.01); *H01F 29/025* (2013.01); *H01F 29/04* (2013.01)

(58) Field of Classification Search
CPC ..... H01F 27/004; H01F 29/025; H01F 29/04; G05F 1/455; G05F 5/00
(Continued)

(56) References Cited

U.S. PATENT DOCUMENTS 3,513,380 A * 5/1970 Vargo ..... H01F 29/04 336/147
6,965,291 B2 11/2005 Haugs
(Continued)

FOREIGN PATENT DOCUMENTS

CN 104393583 3/2015
WO 2008020750 A1 2/2008

OTHER PUBLICATIONS

International Search Report and Written Opinion issued in PCT/IB2020/060480, dated May 27, 2021, 9 pages.
(Continued)

*Primary Examiner* — Quang T Van
(74) *Attorney, Agent, or Firm* — Eversheds Sutherland (US) LLP

(57) ABSTRACT

A system includes conductive windings extending around a magnetic core and impedance-varying windings extending around the magnetic core. The impedance-varying windings include positive windings and negative windings. The conductive windings and the impedance-varying windings conduct electric current around the magnetic core. The system includes a first impedance tap changer that is electrically coupled with the positive windings of the impedance-varying windings and a second impedance tap changer electrically coupled with the negative windings of the impedance-varying windings. A controller controls the first impedance tap changer and the second impedance tap changer to change an impedance of the system by changing which portion of the positive windings and which portion of the negative windings are conductively coupled with the conductive windings, and which portion of the positive windings and which portion of the negative windings are disconnected from the conductive windings.

8 Claims, 11 Drawing Sheets

(51) Int. Cl.

| | |
|---|---|
| ***H01F 27/00*** | (2006.01) |
| ***H01F 29/02*** | (2006.01) |
| ***G05F 1/455*** | (2006.01) |
| ***G05F 5/00*** | (2006.01) |
| *H01F 29/04* | (2006.01) |

(58) Field of Classification Search
USPC ..... 336/10, 12, 30, 40; 219/660–671, 624, 219/630
See application file for complete search history.

(56) References Cited

U.S. PATENT DOCUMENTS

| | | | |
|---|---|---|---|
| 10,193,521 | B2 | 1/2019 | Bakalski |
| 10,319,517 | B2 | 6/2019 | Long |
| 10,389,107 | B1 | 8/2019 | Bengtsson |
| 10,473,707 | B2 | 11/2019 | Bengtsson et al. |
| 2003/0117231 | A1 | 6/2003 | Gerlock |
| 2014/0077913 | A1 | 3/2014 | Weber et al. |
| 2018/0033086 | A1 | 2/2018 | Norris |
| 2018/0330862 | A1* | 11/2018 | Premerlani ..... H01F 29/025 |

OTHER PUBLICATIONS

Fan et al., "Modelling of on-load tap-changer transformer with variable impedance and its applications", Proceedings of EMPD '98. 1998 International Conference on Energy Management and Power Delivery, vol. 2, pp. 491-494.

Zhang et al., "A novel power quality conditioner applied to high voltage power systems", 2006 IEEE Power Engineering Society General Meeting, pp. 1-5.

Kilmer et al., "Variable Impedance Transformer Models for use in Real-Time Security Analysis Functions", IEEE Transactions on Power Apparatus and Systems, vol. PAS-102, Issue: 11, pp. 3558-3563.

* cited by examiner

FLEXIBLE TRANSFORMER SYSTEM

GOVERNMENT LICENSE RIGHTS

This invention was made with U.S. Government support under Contract Number DE-OE0000908 awarded by the United States Department of Energy. The Government has certain rights in the invention.

FIELD

The subject matter described herein relates to transformer systems.

BACKGROUND

Transformers, such as large power transformers, are used in electric power networks to transfer electric power between electromagnetically coupled circuits. While the high availability of transformers is important to prevent disturbances in the transmission of bulk electric power, the readiness for seamless deployment, for example in the case of an emergency or failure, can be important for grid resilience.

A high quality, properly designed large power transformer with suitable protection and supervision relays is a reliable component of the electric power network. When an internal and/or external fault occurs, however, the transformer system can be severely damaged which can lead to a full replacement of the transformer. Even small amounts of damage can require the transformer to be transported to a workshop for repair, leading to significant expenses. The limited number of manufacturers, the limited availability of raw materials (such as magnetic core materials), testing requirements, and special modes of transportation due to the large size and weight of transformers can significantly impact the mean time to repair (MTTR) or time to replace a damaged electric power system.

Among the factors that can impede a quick replacement of a large power transformer, voltage ratio and short-circuit impedance incompatibility of existing spare transformers are two of the critical parameters. Therefore, a transformer equipped with a variable voltage ratio and/or impedance may be deployed more quickly relative to a conventional transformer, reduce the number of required spare units for power utilities, reduce the inventory costs, reduce the system recovery time in the event of a failure or outage, and may improve overall grid resiliency. Furthermore, a transformer equipped with capabilities for adjusting its short-circuit reactance while it is operating may further improve the grid operation and planning, system "health" condition monitoring, reduce the grid recovery time in the event of a failure and/or outage, and further improve overall grid resiliency.

BRIEF DESCRIPTION

In one or more embodiments, a system includes conductive windings extending around a magnetic core and impedance-varying windings extending around the magnetic core. The impedance-varying windings include positive windings and negative windings. The conductive windings and the impedance-varying windings conduct electric current around the magnetic core. The system includes a first impedance tap changer that is electrically coupled with the positive windings of the impedance-varying windings and a second impedance tap changer electrically coupled with the negative windings of the impedance-varying windings. A controller controls the first impedance tap changer and the second impedance tap changer to change an impedance of the system by changing which portion of the positive windings and which portion of the negative windings are conductively coupled with the conductive windings, and which portion of the positive windings and which portion of the negative windings are disconnected from the conductive windings.

In one or more embodiments, a method includes changing an impedance of a system that includes conductive windings and impedance-varying windings extending around a magnetic core by operating a controller coupled with the impedance-varying windings and the conductive windings. Operation of the controller controls which portion of positive windings of the impedance-varying windings is conductively coupled with a first impedance tap changer, and which portion of negative windings of the impedance-varying windings is conductively coupled with a second impedance tap changer.

In one or more embodiments, a system includes conductive windings, voltage-varying windings, and impedance-varying windings extending around a magnetic core. The impedance-varying windings include positive windings and negative windings. The conductive windings, the voltage-varying windings, and the impedance-varying windings conduct electric current around the magnetic core. The system includes a first impedance tap changer that is electrically coupled with the positive windings of the impedance-varying windings and a second impedance tap changer electrically coupled with the negative windings of the impedance-varying windings. A controller controls the first impedance tap changer and the second impedance tap changer to change an impedance of the system by changing which portion of the positive windings and which portion of the negative windings are conductively coupled with the conductive windings, and which portion of the positive windings and which portion of the negative windings are disconnected from the conductive windings. The controller changes a voltage ratio of the system by one or more of conductively decoupling the voltage-varying windings from the conductive windings or changing a direction of a current flow in the voltage-varying windings.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1A:
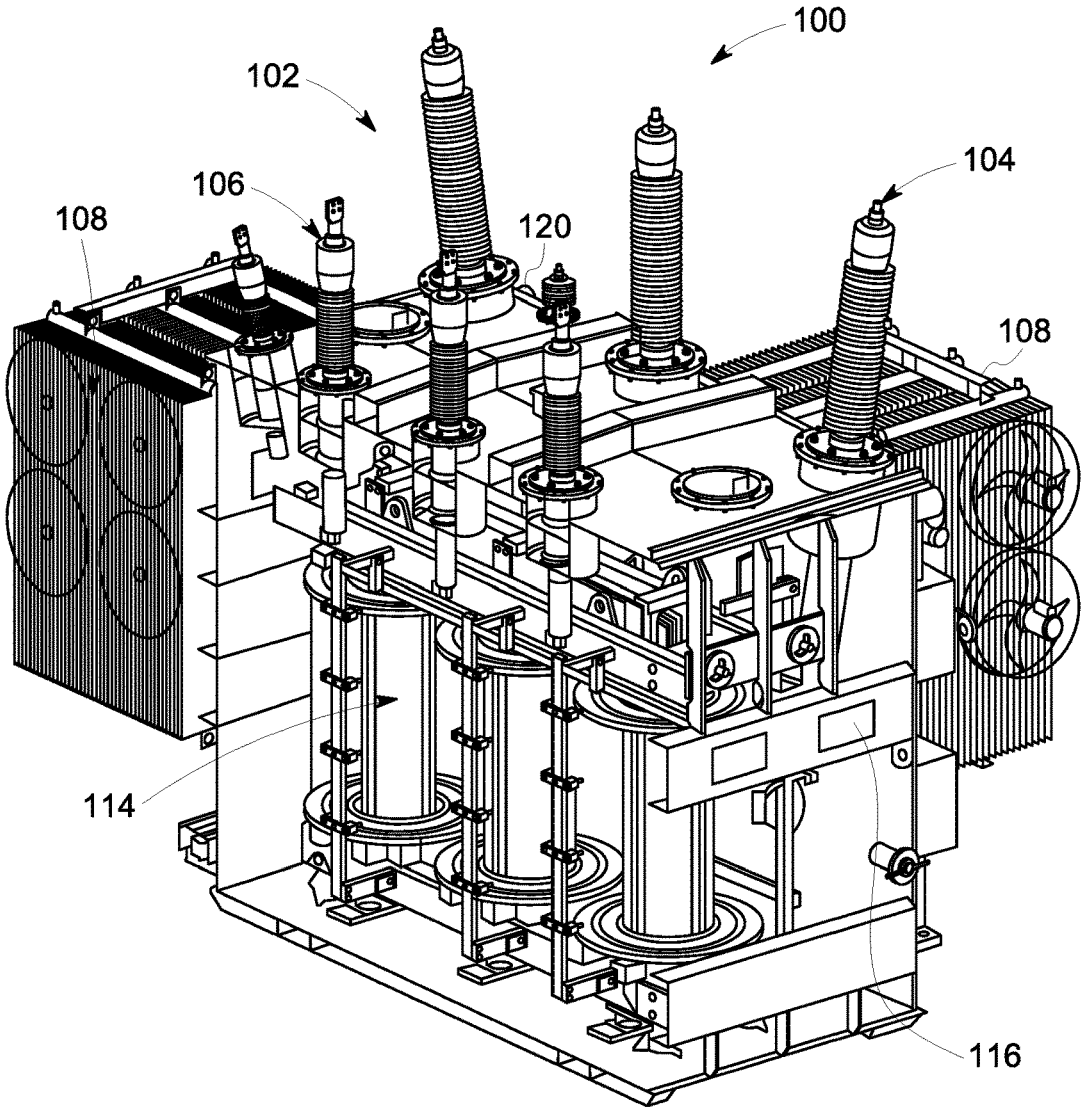
FIG. 1A illustrates a flexible transformer system in accordance with one embodiment.

One or more embodiments of the inventive subject matter described herein provide for flexible transformer systems and methods that are capable of accommodating multiple standard primary to secondary voltage ratios in an electric power grid as well as providing an adjustable short-circuit impedance to match that of a failed transformer to be replaced. In one or more embodiments, the short-circuit impedance may be adjusted by controlling one or more impedance tap changers. Optionally, the impedance tap changers may be controlled online while the system is operating.

One or more technical effects of the subject matter described herein contribute to a control of power that may flow through transmission lines of the system. Optionally, the system may control the power that two transformers in parallel may share. Additionally or alternatively, the systems and methods described herein allow for a single transformer design to serve as a spare for multiple designs of power transformers.

One or more embodiments include tapped voltage-varying windings that enable selection of a transmission class voltage among multiple taps at the low voltage side with the actuation and adjustment of a voltage switch, implementation of a method for selecting the transformer leakage reactance without changing the voltage ratio with impedance-varying windings with the actuation of the impedance tap changers operably coupled with a controller, and arranging and electrically connecting all conductive windings in order to minimize short-circuit forces and dielectric stresses.

One or more technical effects of the subject matter described herein contribute to the enhanced resiliency of existing electric power grid systems by allowing a fast replacement of damaged transformers. Flexibility attributes of the flexible transformer system depend not only on the ability to closely match the transformer primary and/or secondary voltages and partly or fully match the power rating of the systems to be replaced, but also on the ability to match the replaced transformer impedance to coordinate with system short circuit currents and power transfer stability requirements. The subject matter described herein may contribute to reduce a replacement time of a failed transformer by enabling any transformer in a given fleet to match the voltage ratio and the impedance. The subject matter described herein may contribute to reduce or increase the power transfer capability of a transmission line by increasing or decreasing its impedance while the system is online or operating. For example, the system may not need to be shut down, cooled, or the like, before the short-circuit impedance of the replacement system may be adjusted.

In one or more embodiments, the flexible transformer systems described herein may be grid-type transformers, such as 60 Hz transformers. Optionally, the flexible transformer systems may be higher frequency transformers, such as transformers that operate at frequencies levels greater than 60 Hz. Additionally, these higher frequency transformers may use windings other than or in addition to copper windings (e.g., Litz wire) and magnetic cores that may be made of iron and/or ferrite. Optionally, the transformers may be multi-winding transformers, multi-port transformers, multi-core transformers, and/or multi-phase transformers. For example, one of the multi-phase transformers may be a flexible transformer system described herein.

Additionally, one or more technical effects of the subject matter described herein allow for replacement of flexible transformer systems to fit within existing substations with different voltages and physical layouts, and have accessories (e.g., bushings, control cabinet, cooling, control and protection elements, or the like) capable of adapting to different substation control systems. By providing voltage and impedance flexibility, the systems and methods described herein reduce the need for multiple spares, thereby reducing inventory costs for utilities.

The system and methods described herein enable a single transformer design to operate in multiple locations, speeding the replacement process, and reducing the cost of the acquisition of a replacement transformer. One or more technical effects significantly reduces the financial impact on the energy sector by reducing the number of transformers needed to buy, store, and maintain. Large power transformers can be multi-million dollar assets that are not readily available and can require a significant amount of time to be manufactured, tested, transported, and installed. One or more technical effects of the flexible transformer system simplifies the replacement process of damaged systems by allowing the short circuit impedance of the transformer to be adjusted at the facility before energization (e.g., after the transformer has been manufactured and delivered) to match that of the failed unit and/or to be adjusted while the system is operating in the event of a replacement or a transformer operating in parallel.

Additionally, one or more embodiments of the inventive subject matter described herein enable a decoupling selection of the voltage ratio and leakage reactance of the variable transformer system by having separate windings for the voltage ratio and the leakage reactance. For example, the tapped voltage-varying windings for the variable voltage-ratio are designed to provide the desired voltage-ratios with as little leakage reactance as possible. The tapped impedance-varying windings are designed to cover the desired range of leakage reactance values without impacting the voltage ratio. The voltage-ratio and the voltage-varying windings are selected for the desired voltage ratio of the system, and the leakage reactance tap is selected to produce the desired leakage reactance. Adjustment of the leakage reactance will not result in a non-standard set of available voltage taps.

FIG. 1A illustrates a flexible transformer system 100 in accordance with one embodiment. Optionally, the system 100 may be a large power transformer system. The system 100 includes three transformer phases 102 that are disposed within a system housing 120, but optionally may be a single-phase transformer system having a single transformer phase. One or more of the transformer phases 102 includes a high voltage bushing end 104 and a low voltage bushing end 106 that extend outside and away from the system housing 120. For example, the high voltage bushing end 104 may be capable of accommodating 230 kV, 345 kV, 500 kV, 765 kV, or the like. Additionally, the low voltage bushing end 106 may be capable of accommodating 69 kV, 115 kV, 138 kV, 161 kV, 230 kV, or the like. One or more cooling systems 108 operably coupled with the system 100 are configured to cool the temperature of the system 100. For example, the cooling system 108 may include fans, exhaust systems, coolant systems, or the like, configured to maintain a temperature of the system 100 within a designated temperature range.

Figure 1B:
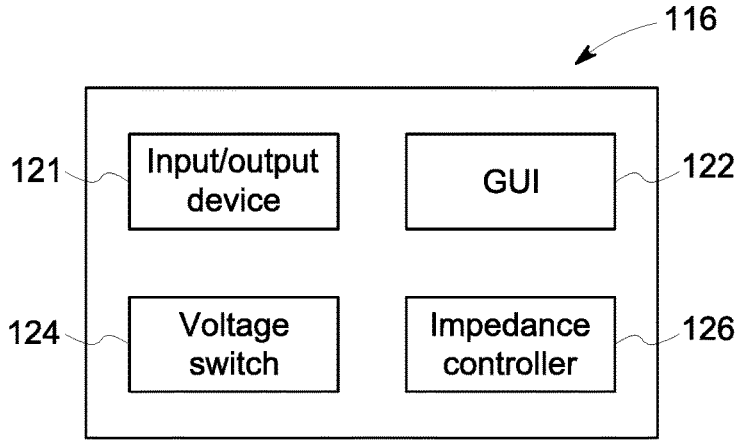
FIG. 1B illustrates a controller of a flexible transformer system in accordance with one embodiment.
Figure 1C:
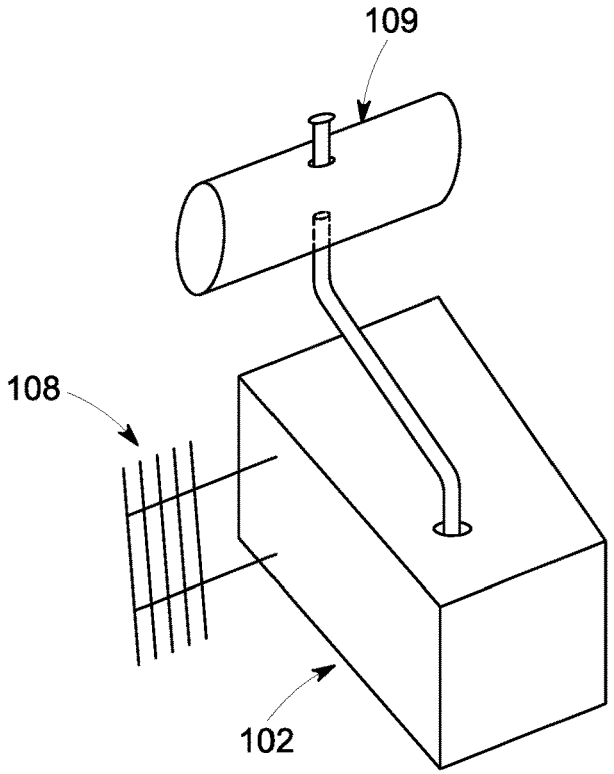
FIG. 1C illustrates an example of a fluid conservator tank in accordance with one embodiment.

In one or more embodiments, one or all of the flexible transformer phases 102 may be operably coupled with one or more fluid conservator tanks. For example, FIG. 1C illustrates a fluid conservator tank 109 that is fluidly coupled with one of the transformer phases 102. The fluid conservator tank 109 may hold or contain oil, or any alternative fluid that may be used by the system 100. Optionally, the tank 109 may be fluidly coupled with more than one of the transformer phases 10, two or more tanks 109 may be coupled with one or more of the transformer phases 102, or any combination therein. The fluid conservator tank 109 may be used to control thermal expansion of transformer fluid during operation of the system 100. For example, the tank 109 and/or the transformer phase 102 may include internal means to preserver transformer fluid that may be free from contact with external and/or surrounding ambient air.

Each of the transformer phases 102 are disposed inside of a housing 114 within the system housing 120. For example, conductive windings, electrical switches terminations, a magnetic core, and the like, of each transformer phase 102, are disposed inside of the housing 114. In the illustrated embodiment, the transformer system 100 includes three transformer phases 102 that are individually contained within three separate and distinct housings 114. Optionally, the system 100 may include less than three or more than three transformer phases 102, that may be contained within common and/or separate housings. The details of the components contained within the housing 114 will be discussed in more detail below with FIG. 2.

Optionally, in one or more embodiments, the system 100 includes at least one transformer phase 102 for a single-phase transformer system 100 having high voltage bushings, low voltage bushings, cooling systems, a tank including insulating materials (e.g., oil, paper, or the like), an impedance switch, a voltage switch, additional instrumentation and/or protection relays, and the like. Optionally, in one or more embodiments, the system 100 includes three transformer phases 102 for a three-phase transformer system 100 having high voltage bushings, low voltage bushings, cooling systems, a tank including insulating materials (e.g., oil, paper, or the like), a common impedance switch or individual impedance switches for each phase, a common voltage switch or individual voltage switches for each phase, additional instrumentation and/or protection relays, and the like.

The system 100 includes a controller 116 that is disposed on an exterior surface of the system housing 102. An operator of the system 100 may control the system 100 via the controller 116. For example, the controller 116 may be positioned at a location that can be accessed by the operator. FIG. 1B is a schematic illustration of the controller 116. The controller 116 may also be referred to as a workstation, or the like. The controller 116 may include data processing circuitry, including one or more computer processors (e.g., microcontrollers), or other logic-based devices that perform operations based on one or more sets of instructions (e.g., software). An operator of the system 100 may control the voltage ratio of the system 100 and/or a leakage reactance of the system 100 by controlling one or more processors of the controller.

The controller 116 may include, among other things, one or more input and/or output devices 121 (e.g., keyboard, electronic mouse, printer, or the like), a graphical user interface or GUI 122, a voltage switch 124, and an impedance controller 126. The voltage switch and/or the impedance controller may be mechanically or solid-state switches, knobs, buttons, toggles, a touch screen, or the like. The impedance controller 126 is electrically connected with one or more impedance tap changers (not shown) of the system 100. For example, the impedance tap changers may be motorized systems that may allow for variable turn ratios of impedance-varying windings to be selected. The controller 116 may be electrically connected with one or more windings included in each transformer phase 102 of the system 100 based on a manipulation of the impedance controller 126 by an operator of the system 100. For example, an operator may change an impedance of the transformer phase 102 and/or change the impedance of the system 100 by controlling the impedance controller 126 to control an amount of power that passes through the system 100. Optionally, the controller 116 may be manipulated to change the impedance of the system 100 to control an amount of a fault current that may be allowed to move through the system 100. For example, the controller 116 may increase or decrease the amount of fault current allowed to move through the system 100, allowed to move through each of the individual transformer phases 102, or the like. Optionally, the controller 116 may control the impedance of one or more transformer phases 102 of the system 100 in order to balance an amount of power that may be allowed to flow through each of the transformer phases 102.

In one or more embodiments, the operator may manipulate the impedance controller 126 to change the impedance of one or more of the transformer phases 102 or the impedance of the system 100 while the transformer phase 102 is operating. The impedance controller 126 controls operation of each of the one or more impedance tap changers. For example, the impedance controller 126 directs the one of the impedance tap changers to selectively couple with a portion of positive windings of the impedance-varying windings, and another impedance tap changer to selectively couple with a portion of negative windings of the impedance-varying windings.

In one or more embodiments, the transformer phase 102 may include at least two impedance tap changers. Optionally, the transformer phase 102 may include any number of impedance tap changers. The impedance controller 126 controls operation of first and second impedance tap changers of the transformer phase 102 by directing the first and second impedance tap changers to selectively and electrically couple with a first portion of the impedance-varying windings. For example, the first impedance tap changer may electrically couple with a portion of positive windings and the second impedance tap changer may electrically couple with a portion of negative windings of the impedance-varying windings. Subsequently, the impedance controller 126 may direct the first and second impedance tap changers to selectively and electrically couple with a different, portion of the positive and negative impedance-varying windings, respectively. The impedance tap changers will be described in more detail below.

In one or more embodiments, the system 100 may include separate controllers for each transformer phase 102 of the system 100. For example, FIG. 1A illustrates the system 100 having three transformer phases 102. The system 100 may include three controllers individually electrically connected to the windings of each of the three different transformer phases 102.

The voltage switch 124 may be electrically connected with one or more voltage-varying windings of the transformer phase 102. For example, an operator may change the voltage ratio of each of the transformer phases 102 and/or change the voltage ratio of the system 100 by changing a setting of the voltage switch 124. The voltage switch 124 may selectively couple voltage-varying windings with conductive windings of the transformer phase 102. Optionally, the voltage switch 124 may control operation of a voltage tap changer to selectively couple voltage-varying windings with conductive windings.

In one or more embodiments, the system 100 is a flexible three-phase large power autotransformer intended for transmission class applications having a power capacity ranging between and including 100 Mega Volt Amperes (MVA) to 600 MVA. Optionally, the system 100 may be a single-phase large power autotransformer system having a power capacity less than 300 MVA and/or greater than 600 MVA. In one or more embodiments, the system 100 may be capable of accommodating three standard voltage ratios with a fixed high-side voltage rate for example at 345 kV and three configurable taps at the low-side for operation at for example 115 kV, 138 kV, or 161 kV. Optionally, the system may have a flexible or fixed high-side voltage rate, a flexible or fixed low-side voltage rate, or any combination thereof. For example, the system 100 may be capable of accommodating one or more voltage ratios including 345 kV/161 kV, 345 kV/138 kV, 345 kV/115 kV, 345 kV/69 kV, 230 kV/161 kV, 230 kV/138 kV, 230 kV/115 kV, 230 kV/69 kV, 500 kV/230 kV, 500 kV/161 kV, 500 kV/138 kV, 500 kV/115 kV, or 500 kV/69 kV.

In one or more embodiments, the flexible transformer system 100 has an impedance that is adjustable within a wide range (e.g., 4%-18%) based on a self-cooled power rating of the transformer. Optionally, the transformer system 100 may have an adjustable impedance less than 4% and/or greater than 18% based on the self-cooled power rating of the transformer. The variable voltage and the variable impedance of the system 100 are discussed in more detail below.

In one or more embodiments, the system 100 may be identified as an autotransformer for use in transmission class applications. Optionally, the system 100 may be designed for conventional transformers having separate primary and secondary windings. In one or more embodiments, the system 100 is intended to be used in conventional substations. Optionally, the system 100 may be designed to be used for mobile substations.

Figure 2:
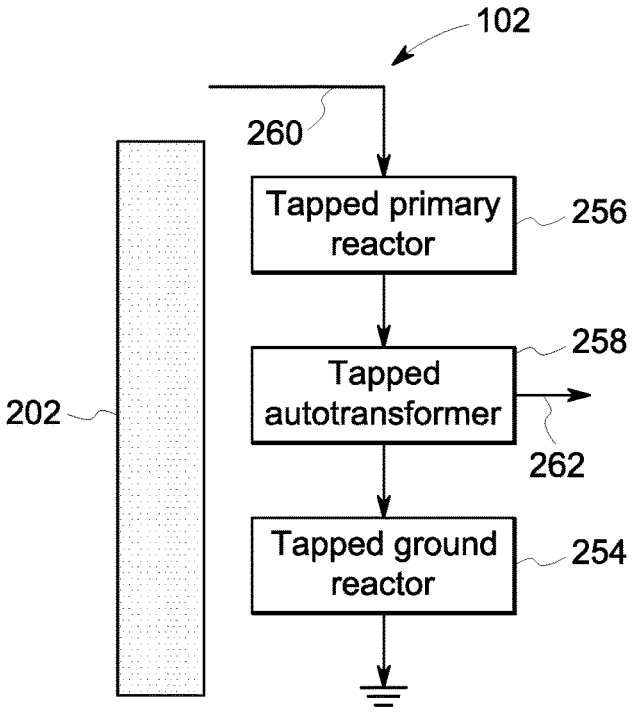
FIG. 2 illustrates a schematic representation of a transformer one-phase winding in accordance with one embodiment.

FIG. 2 illustrates a schematic representation of one of the three transformer phases 102 shown in FIG. 1A in accordance with one embodiment. Each of the transformer phases 102 has a tapped primary reactor 256 located near the high voltage bushing end 104, a tapped autotransformer 258, and a tapped ground reactor 254 located near the low voltage bushing end 106 relative to the tapped primary reactor 256. The tapped primary reactor 256 has multiple segments of impedance-varying windings and the tapped ground reactor 254 has multiple segments of impedance-varying windings that extend around a common magnetic core 202. Optionally, the transformer phase 102 may include either the tapped primary reactor 256 or the tapped ground reactor 254. The tapped autotransformer 258 has conductive windings that also extend around the common magnetic core 202. For example, the tapped autotransformer 258 may be designed for minimum reactance, and the tapped ground and primary reactors 254, 256 may be designed to be integrated with the tapped autotransformer 258 to provide a range of additional reactance values up to a designated threshold.

The magnetic core 202 provides electromagnetic coupling for the tapped autotransformer 258 but does not provide electromagnetic coupling for the tapped primary reactor 256 or the tapped ground reactor 254. For example, the magnetic core 202 provides only mechanical mounting for the impedance-varying windings of the tapped primary and tapped ground reactors 256, 254.

The transformer phase 102 has a primary conductor 260 and a secondary conductor 262. The primary conductor 260 is electrically connected with the high voltage bushing end 104 of FIG. 1. For example, the primary conductor 260 electrically connects the high voltage bushing end 104 with the tapped primary reactor 256 of the transformer phase 102. The secondary conductor 262 is tapped from the tapped autotransformer 258 and is coupled with one or more voltage-varying windings of the transformer phase 102. For example, the tapped secondary conductor 262 electrically connects the voltage-varying windings with the tapped autotransformer 258 in order to provide the desired voltage ratio of the transformer phase 102 with minimal leakage reactance. The voltage-varying windings are described in more detail below.

Figure 3:
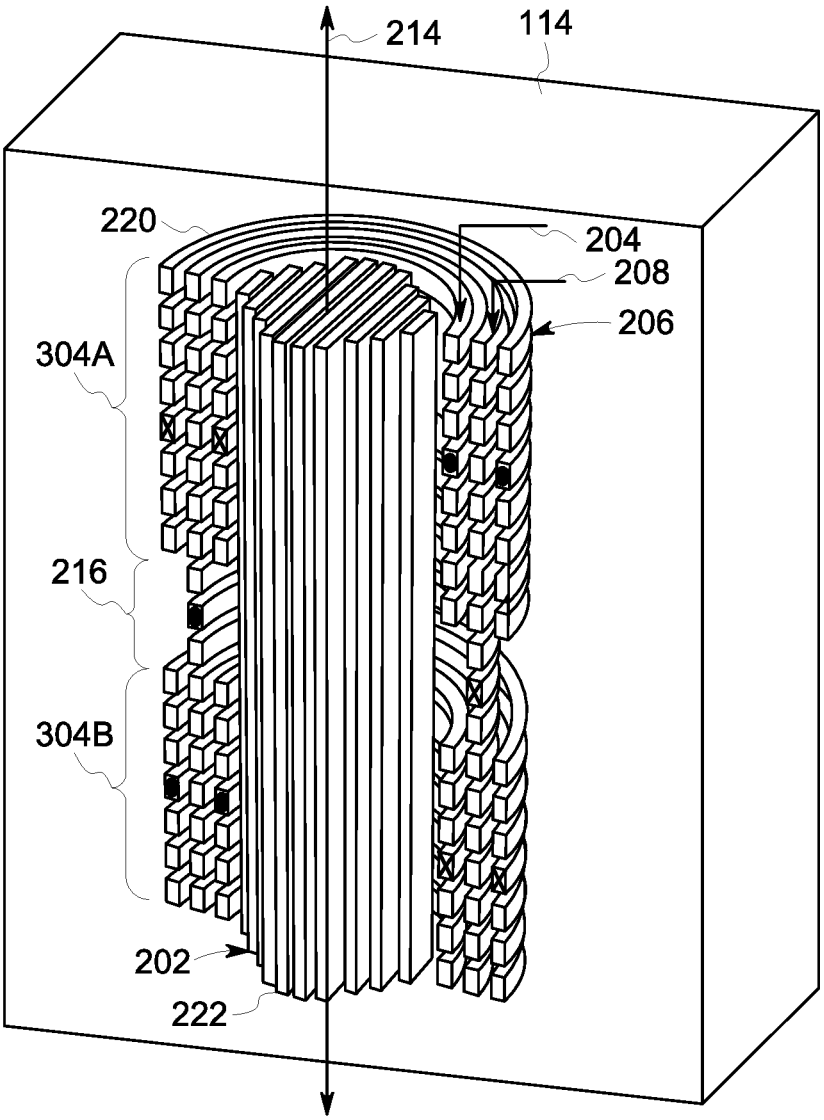
FIG. 3 illustrates a cross-sectional perspective view of integrated impedance-varying windings with conductive windings of a transformer in accordance with one embodiment.

FIG. 3 illustrates a cross-sectional perspective view of integrating impedance-varying windings with conductive windings of one of the three transformer phases 102 of FIG. 1. Conductive windings 208 of the tapped autotransformer 258 (of FIG. 2) extend around the magnetic core 202 of the transformer phase 102. For example, the conductive windings 208 may be primary or main voltage windings of the system 100. Optionally, the conductive windings 208 may carry alternative electric power through the system 100. The magnetic core 202 has a generally circular cross-sectional shape and is generally cylindrical and elongated along an axis 214 between a first end 220 and a second end 222. Alternatively, the magnetic core 202 may have another cross-sectional shape. The magnetic core 202 is manufactured of a magnetic material having a high magnetic permeability that is used to guide magnetic fields in electrical, electromechanical, and magnetic devices. The magnetic core 202 provides electromagnetic coupling for the transformer phase 102 with the additional phases 102 of the system 100. The conductive windings 208 extend around the magnetic core between the first end 220 and the second end 222 in order to transform the magnetic flux generated by the magnetic core 202 of the transformer phase 102 into voltage and electric current.

The transformer phase 102 also includes the ground impedance-varying windings 204 of the tapped ground reactor 254 and primary impedance-varying windings 206 of the tapped primary reactor 256 that are mechanically wrapped around the magnetic core 202. The impedance-varying windings of the tapped ground reactor and the tapped primary reactor are configured to adjust a short-circuit impedance of the transformer phase 102 between different available impedance values. Adjusting the short-circuit impedance of the transformer phase 102 will be discussed in more detail below.

The ground impedance-varying windings 204 extend around the magnetic core 202 between the magnetic core 202 and the conductive windings 208. The primary impedance-varying windings 206 extend around the magnetic core 202 outside of the conductive windings 208. For example, the primary impedance-varying windings 206 are distal to the magnetic core 202 relative to the ground impedance-varying windings 204. In the illustrated embodiment, the transformer phase 102 includes the impedance-varying windings of the tapped ground reactor 254 and the tapped primary reactor 256 (shown in FIG. 2). Optionally, the transformer phase 102 may include either the ground impedance-varying windings 204 or the primary impedance-varying windings 206.

The impedance-varying windings 204, 206 include a number of even windings 304A and the same number of odd windings 304B. The even windings 304A extend around the magnetic core 202 at the first end 220 of the magnetic core 202, and the odd windings 304B extend around the magnetic core 202 at the opposite, second end 222 of the magnetic core 202. For example, the even windings 304A may be wrapped in a first polarity (e.g., positive), and the odd windings 304B may be wrapped in an opposite, second polarity (e.g., negative) relative to the even windings 304A. The even windings 304A and the odd windings 304B are separated by a gap 216 along the axis 214 of the magnetic core 202. At the gap 216, the conductive windings 208 of the transformer 102 are exposed. For example, the conductive windings 208, positioned between a layer of the ground impedance-varying windings 204 and the primary impedance-varying windings 206, are visible within the gap 216 and may not be visible outside of the gap 216 along the axis 214 of the magnetic core 202. Optionally, the impedance-varying windings 204 and 206 may have a different number of taps. For example, the number of taps in the even windings 304A of the impedance-varying windings 204 may be different than the number of taps in the even windings 304A of the impedance varying windings 206.

By positioning the even windings 304A at the first end 220 and the odd windings 304B at the second end 222, the resulting magnetic coupling between the magnetic core 202 and the impedance-varying windings 204, 206 is essentially zero. For example, the symmetry of the same number of even windings 304A and odd windings 304B at opposite ends of the magnetic core 202 electrically decouples the impedance-varying windings 204, 206 from the conductive windings 208 of the transformer phase 102. Positioning the even windings 304A at the first end 220 and the odd windings 304B at the second end 222 of the magnetic core 202 increases the amount of reactance that can be obtained for a given number of winding turns relative to the even windings 304A not being separated from the odd windings 304B by the gap 216. Additionally, positioning the even windings 304A at the first end 220 and the odd windings 304B at the second end 222 allows the transformer phase 102 to achieve a net magnetic flux of substantially zero while the even windings 304A and the odd windings 304B enable the same amount of magnetic flux with opposite signs (e.g., positive and negative). Optionally, one or more of the ground impedance-varying windings 204, the primary impedance-varying windings 206, the even windings 304A or the odd windings 304B may be positioned in an alternative arrangement. For example, the even and odd windings 304A, 304B may be arranged in an alternating pattern. Alternatively, the windings 204, 206, 304A, 304B may be arranged in any other arrangement. For example, an alternative configuration of the impedance-varying windings 204, 206 and the conductive windings 208 will be discussed in FIGS. 4 and 5.

Figure 4:
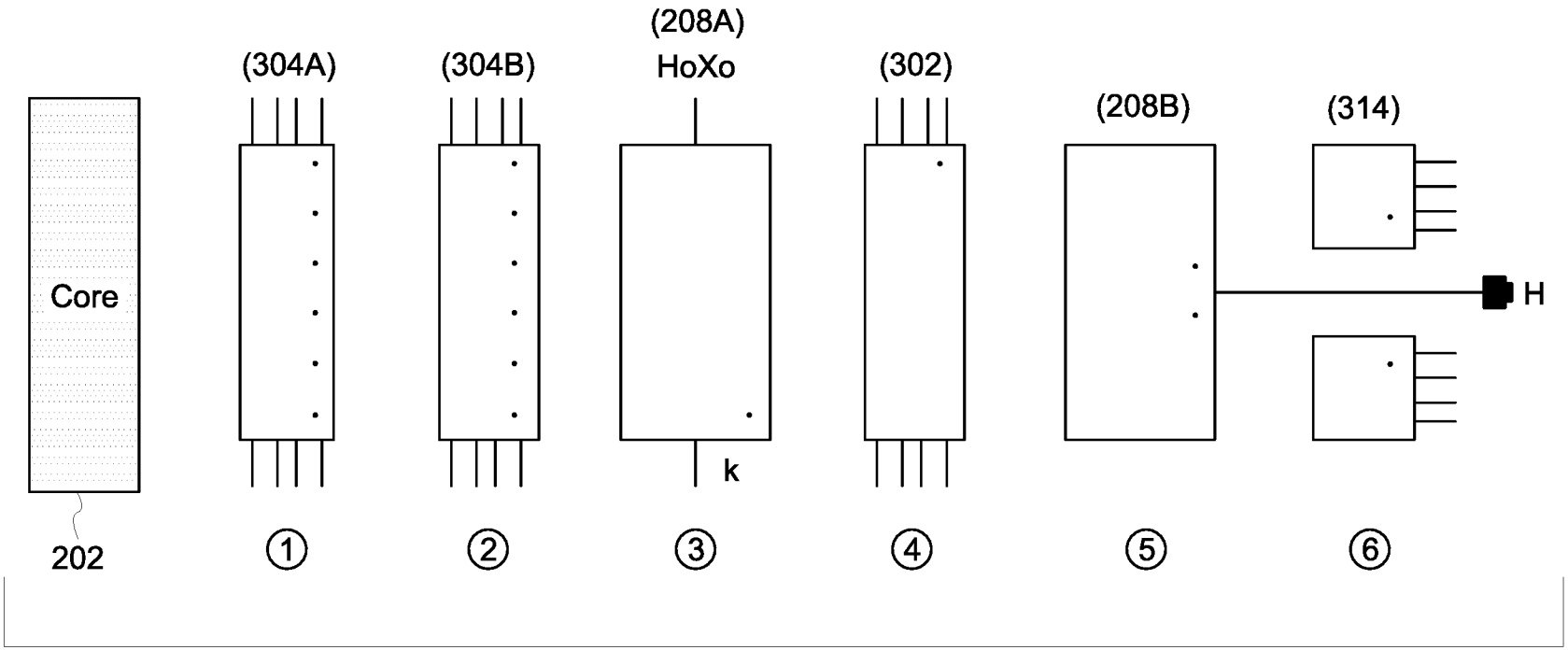
FIG. 4 illustrates a layout of circuitry of integrated impedance-varying windings with conductive windings of a transformer in accordance with one embodiment.
Figure 5:
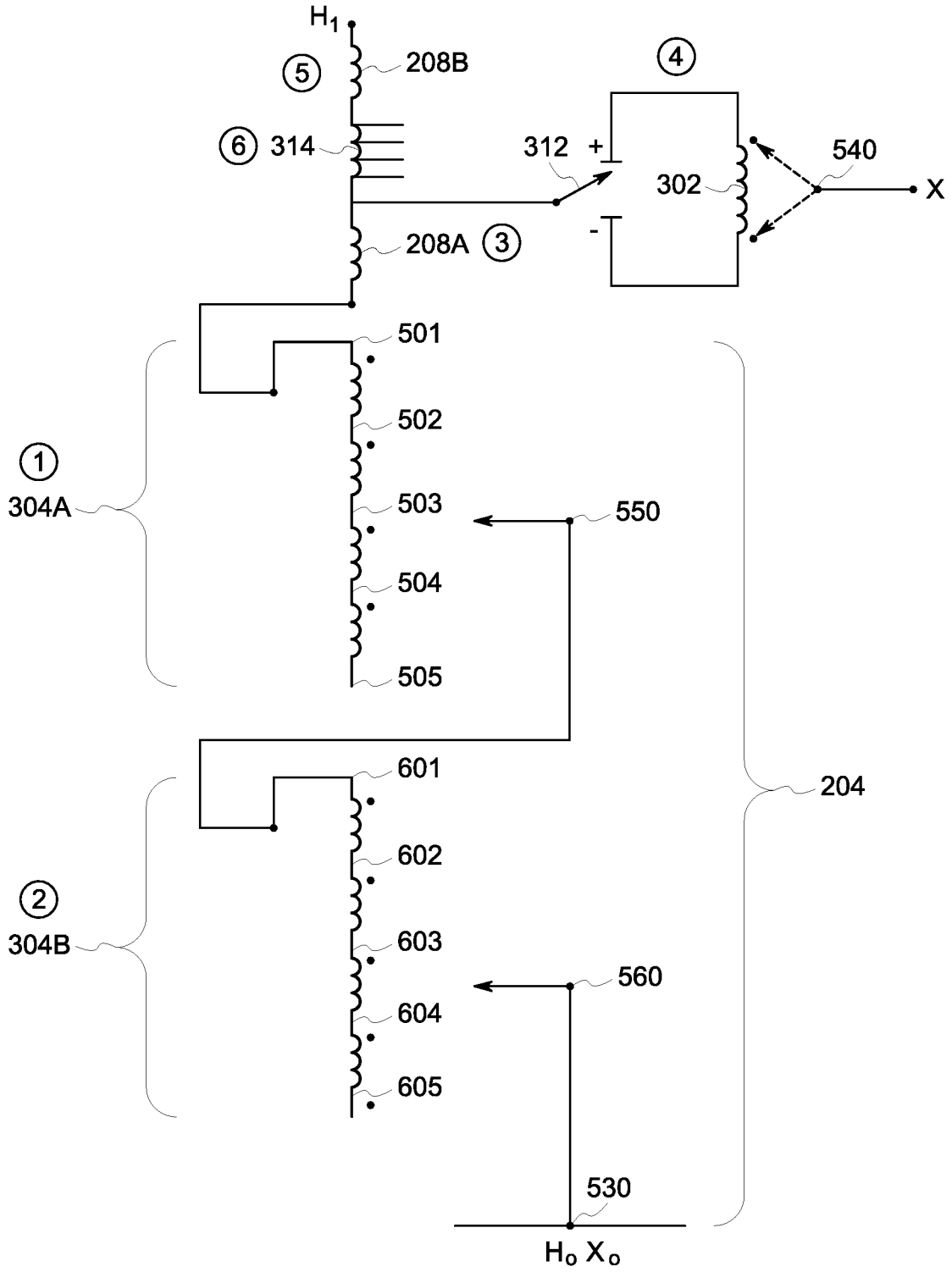
FIG. 5 illustrates a schematic representation of the circuitry of integrated impedance-varying windings illustrated in FIG. 4, in accordance with one embodiment.

FIG. 4 illustrates a general layout of the circuitry for integrating impedance-varying windings with conductive windings of a transformer phase 102. FIG. 5 illustrates a schematic representation of the circuitry. For example, FIG. 4 illustrates one example of a set of coaxial, cylindrical windings to illustrate the relative location of the windings to the magnetic core 202 of the transformer phase 102. FIGS. 4 and 5 will be discussed in detail together.

Winding 3 in FIG. 4 illustrates the conductive windings 208A of the tapped autotransformer 258. The conductive windings 208A include the turns necessary to provide a lower secondary voltage output of the transformer phase 102 relative to the conductive windings 208A including more turns than necessary. Winding 1 is an auxiliary positive turn, multiturn coil that contributes to flexible high to/from low impedance of the system 100. For example, Winding 1 illustrates the impedance-varying even windings 304A of the transformer phase 102 short circuit impedance. Winding 2 is an auxiliary negative turn, multiturn coil that contributes to the flexible high to/from low impedance of the system 100. For example, Winding 2 illustrates the impedance-varying odd windings 304B of the transformer phase 102 short circuit impedance. Winding 2 operates in combination with the Winding 1 to produce a net-zero effective turns. For example, the magnetic coupling out of Winding 1 and Winding 2 (e.g., the even 304A and odd 304B windings of the ground impedance-varying windings 204) is substantially zero. The impedance-varying windings 204 are made of multiple segments of windings (e.g., coils) such that the impedance-varying windings 204 are separated into pairs of odd and even windings 304A, 304B.

In one or more embodiments, the tapped ground reactor 254 (shown in FIG. 2) has multiple segments of impedance-varying windings 204. The ground impedance-varying windings 204 extend around the magnetic core 202 of the transformer phase 102. The tapped ground reactor 254 may have any number of segments of windings and/or any number of taps. The impedance-varying windings 204 and the taps provide a range of leakage reactance values of the system 100. For example, the taps and the impedance-varying windings 204 enable the impedance of the transformer phase 102 to change within a range from 4%-12% by changing a setting of the impedance controller 126 (of FIG. 1B). The method of changing the impedance of the transformer phase 102 will be discussed in more detail below.

The ground impedance-varying windings 204 have positive and negative polarity relative to other conductive windings that extend around the magnetic core 202. For example, the ground impedance-varying windings 204 are separated into the even windings 304A and the odd windings 304B. The tapped ground reactor 254 has the same number of even windings 304A and odd windings 304B. The odd windings 304B and the even windings 304A are electrically equivalent and are connected in a way in order to produce opposite magnetic fluxes. For example, the net magnetic flux out of one pair of windings (including one even winding 304A and one odd winding 304B) is approximately zero allowing the impedance-varying windings 204 to be magnetically decoupled from the voltage-varying windings. For example, by having the same number of even windings 304A as odd windings 304B, the magnetic coupling between the ground impedance-varying windings 204 and the magnetic core 202 is approximately zero.

The taps are positioned such that the even windings 304A and odd windings 304B may be operationally selected in pairs. For example, by changing the reactor tap by changing a setting of the impedance controller 126 (e.g., changing the impedance of the transformer phase 102), the overall voltage between the tapped ground reactor 254 and the overall transformer phase 102 is substantially unchanged. Additionally or alternatively, electrical coupling between the tapped primary reactor 256 and/or the tapped ground reactor 254 and the leakage reactance of the transformer phase 102 is substantially zero. Therefore, the voltages between the taps during a fault on the terminals of the transformer phase 102 are minimal.

In the illustrated embodiment of FIG. 5, taps 501, 502, 503, 504, 505 of the even windings 304A and taps 601, 602, 603, 604, 605 of the odd windings 304B are shown as open circuits. A first impedance changer 550 corresponding to the even windings 304A is operably coupled with the controller 116 and a second impedance changer 560 corresponding to the odd windings 304B is operably coupled with the controller 116. An operator of the system 100 may change the impedance of the system 100 by controller the first and second impedance changers 550, 560. For example, the operator of the system 100 may change the impedance of the system 100 by changing a setting of the impedance controller 126 (of FIG. 1B) to connect the HoXo bushing internal end (e.g., tap 530) to any of the taps 501-505 via the first impedance tap changer 550, and any of the taps 601-605 via the second impedance tap changer 560.

In one or more embodiments, the impedance controller 126 of the controller 116 may be a knob that can be turned to one or more settings to change the first and second impedance tap changers 550, 560. Optionally, the impedance controller 126 may be a keypad, touch screen, or the like, such that the operator is configured to select and/or enter in a code corresponding to settings of the first and second impedance tap changers 550, 560. A single selection, manipulation, indication, or the like, by the operator via the impedance controller 126 changes which of the taps 501-505 that the first impedance tap-changer 550 is electrically coupled with, and changes which of the taps 601-605 that the second impedance tap changer 560 is electrically coupled with.

Additionally, manipulation of the impedance controller 126 changes the first and second impedance tap changers 550, 560 substantially simultaneously. For example, the operator may change which of the taps 501-505 that the first impedance tap changer 550 is electrically coupled with, and change which of the taps 601-605 that the second impedance tap changer 560 is electrically coupled with at substantially the same time via a single manipulation of the controller 116.

The taps 501-505 of the even windings 304A of the impedance-varying windings 204 correspond to the taps 601-605 of the odd windings 304B of the impedance-varying windings 204. As one example, the operator may use the controller 116 to change the transformer phase to have a lowest impedance leakage setting. By manipulating the controller 116 to direct the system 100 to change the phase 102 to have a lowest impedance leakage setting, the first impedance tap changer 550 may be electrically coupled with a first even tap 501, and the second impedance tap changer 560 may be electrically coupled with a first odd tap 601. For example, by connecting the first impedance tap changer 550 to the first even tap 501 and connecting the second impedance tap changer 560 to the first odd tap 601, the smallest transformer impedance value is obtained relative to connecting to even taps 502-505 and connecting to odd taps 602-605. By changing the impedance of the system 100, an amount of power that may pass through the system may be controlled. Additionally or alternatively, by changing the impedance of the system 100, an allowable fault current level of the system may be changed. For example, the allowable fault current level may be a predetermined threshold that when passed, the system 100 faults. By changing the impedance of the system 100, the allowable fault current level may be changed from the predetermined or preset threshold, to a threshold having a greater value, or a threshold having a lesser or lower value.

Alternatively, the operator may use the controller 116 to change the transformer phase 102 to have a highest impedance leakage setting. By manipulating the controller 116 to change the impedance to the highest setting, the first impedance tap changer 550 may be electrically coupled with a fifth even tap 505, and the second impedance tap changer 560 may be electrically coupled with a fifth odd tap 605. For example, by connecting the first impedance tap changer 550 to the fifth even tap 505 and connecting the second impedance tap changer 560 to the fifth odd tap 605, the largest transformer impedance value is obtained relative to connecting to the even taps 501-504 and connecting to the odd taps 601-604. For example, the impedance controller 126 changes the impedance of the system 100 by changing the portion of the impedance-varying windings that are connected to the conductive windings, and the portion of the impedance-varying windings that are decoupled from the conductive windings.

In the illustrated embodiment, the impedance varying windings 204 includes four even windings 304A and four odd windings 304B. Optionally, the transformer phase may have any number of even windings, and a same number of odd windings. The same or common number of even and odd windings allows a leakage reactance of the system to change without impacting the voltage ratio of the system 100. The impedance-varying windings 204 are designed with the taps 501-505, 601-605 to allow the reactance value of the system 100 to changes by changing the position of the odd and even taps. Additionally, the position of the odd and even taps may change while the system 100 is operating.

Figure 6:
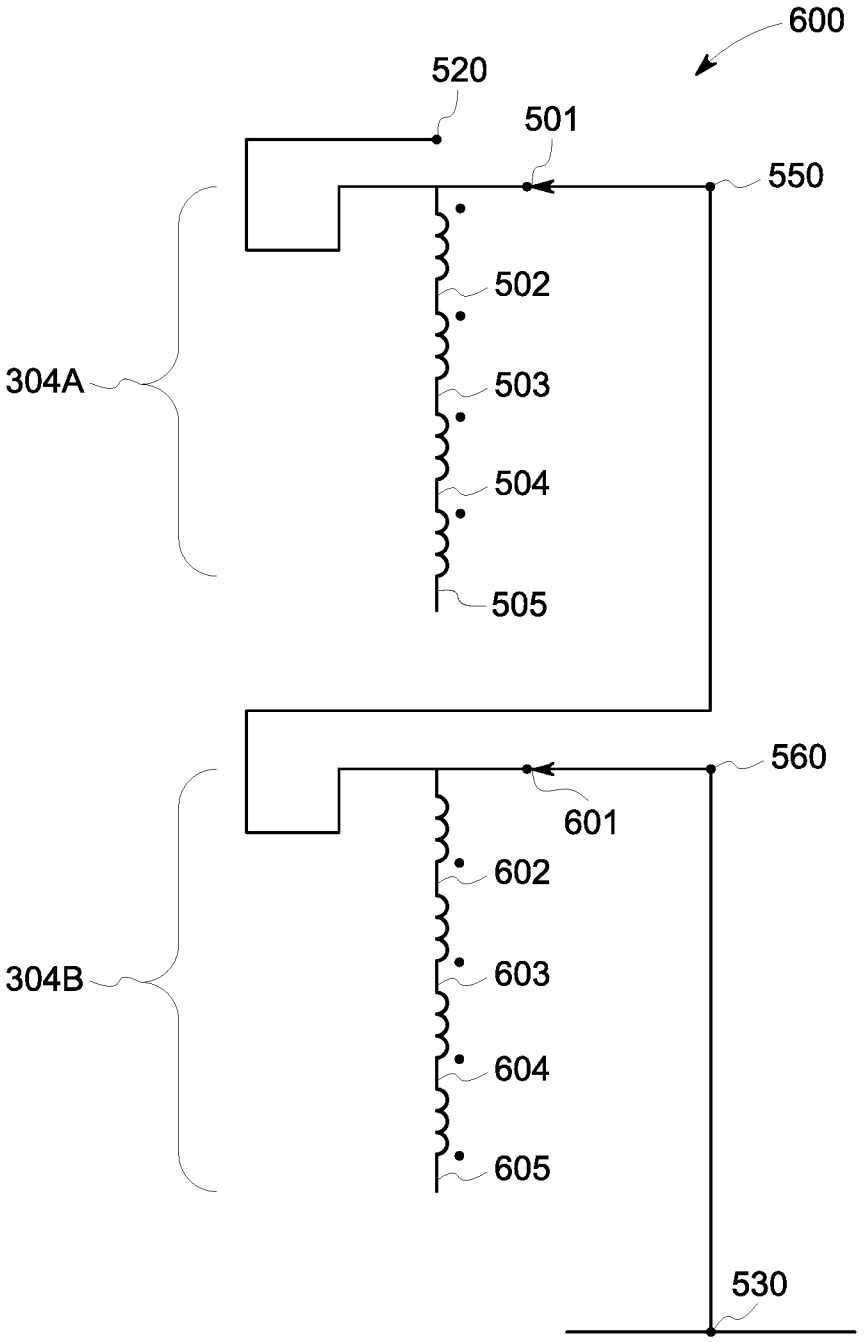
FIG. 6 illustrates a schematic representation of the circuitry of impedance-varying windings based on a first setting of a controller in accordance with one embodiment.

FIG. 6 illustrates a schematic representation of the circuitry of the impedance-varying windings 204 based on a first setting 600 of the impedance controller 126 in accordance with one embodiment. The first setting 600 of the impedance controller 126 illustrates the transformer phase 102 having a minimum impedance by bypassing even windings 304A and odd windings 304B and electrically coupling the first impedance tap changer 550 with the first even tap 501, and electrically coupling the second impedance tap changer 560 with the first odd tap 601.

Figure 7:
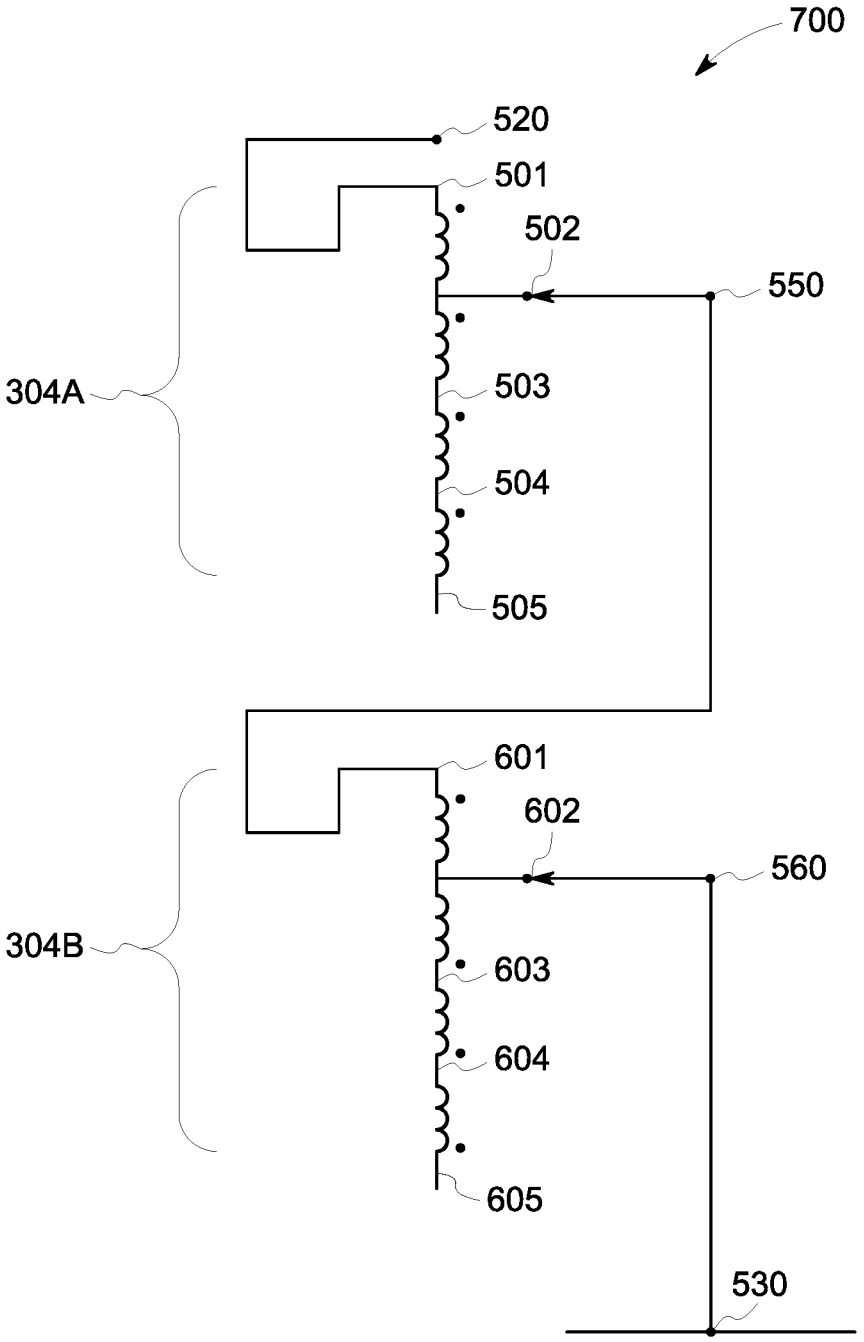
FIG. 7 illustrates a schematic representation of the circuitry of impedance-varying windings based on a second setting of a controller in accordance with one embodiment.

FIG. 7 illustrates a schematic representation of the circuitry of the impedance-varying windings 204 based on a second setting 700 of the impedance controller 126. The second setting 700 of the controller 116 illustrates the transformer phase 102 having an impedance that is greater than the impedance of the first setting 600 of by electrically coupling the first impedance tap changer 550 with a second even tap 502, and electrically coupling the second impedance tap changer 560 with a second odd tap 602.

Figure 8:
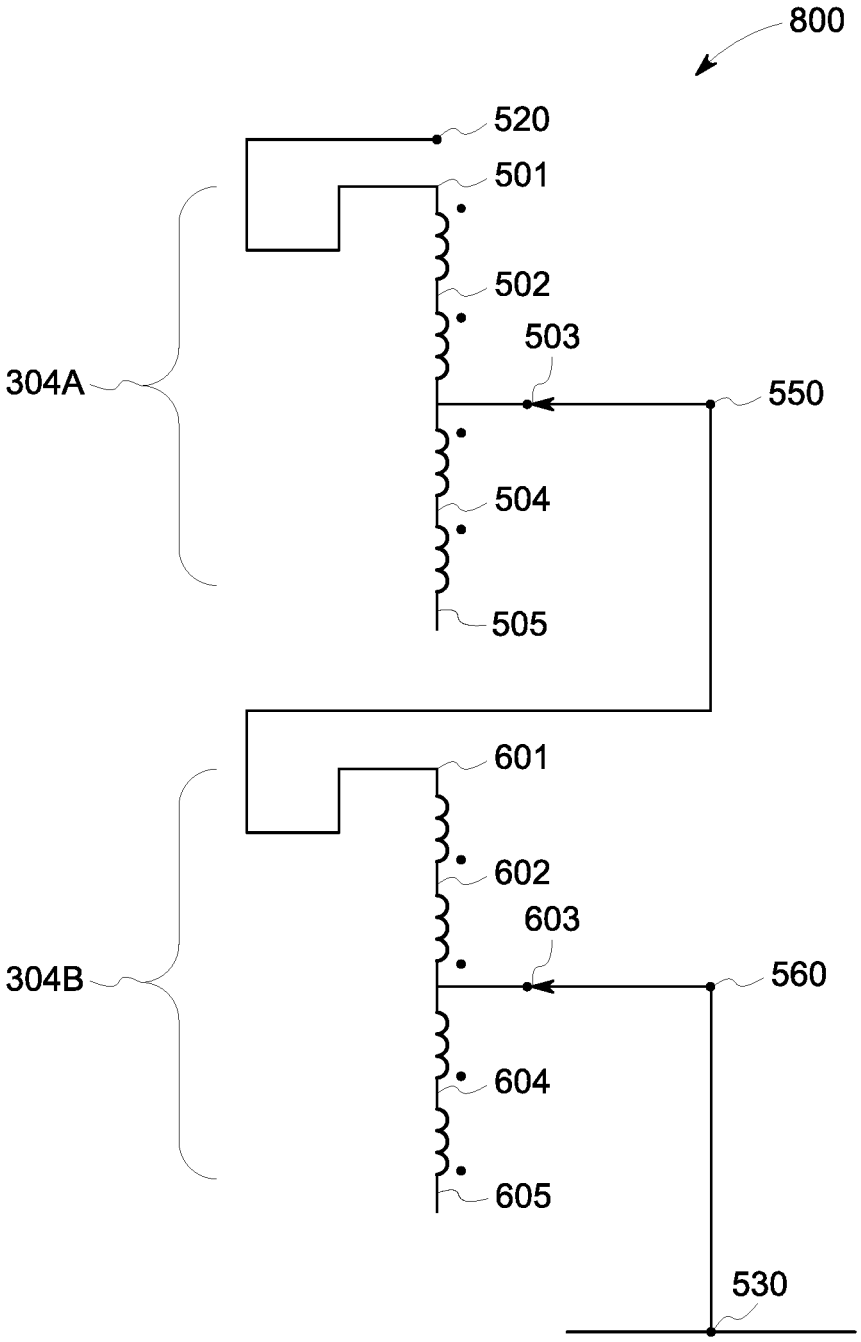
FIG. 8 illustrates a schematic representation of the circuitry of impedance-varying windings based on a third setting of a controller in accordance with one embodiment.

FIG. 8 illustrates a schematic representation of the circuitry of the impedance-varying windings 204 based on a third setting 800 of the impedance controller 126. The third setting 800 of the impedance controller 126 illustrates the transformer phase 102 having an impedance that is greater than the impedance of the second setting 700 of FIG. 7, and having an impedance that is greater than the impedance of the first setting 600 of FIG. 6. The third setting 800 electrically couples the first impedance tap changer 550 with a third even tap 503, and electrically couples the second impedance tap changer 560 with a third odd tap 603.

Figure 9:
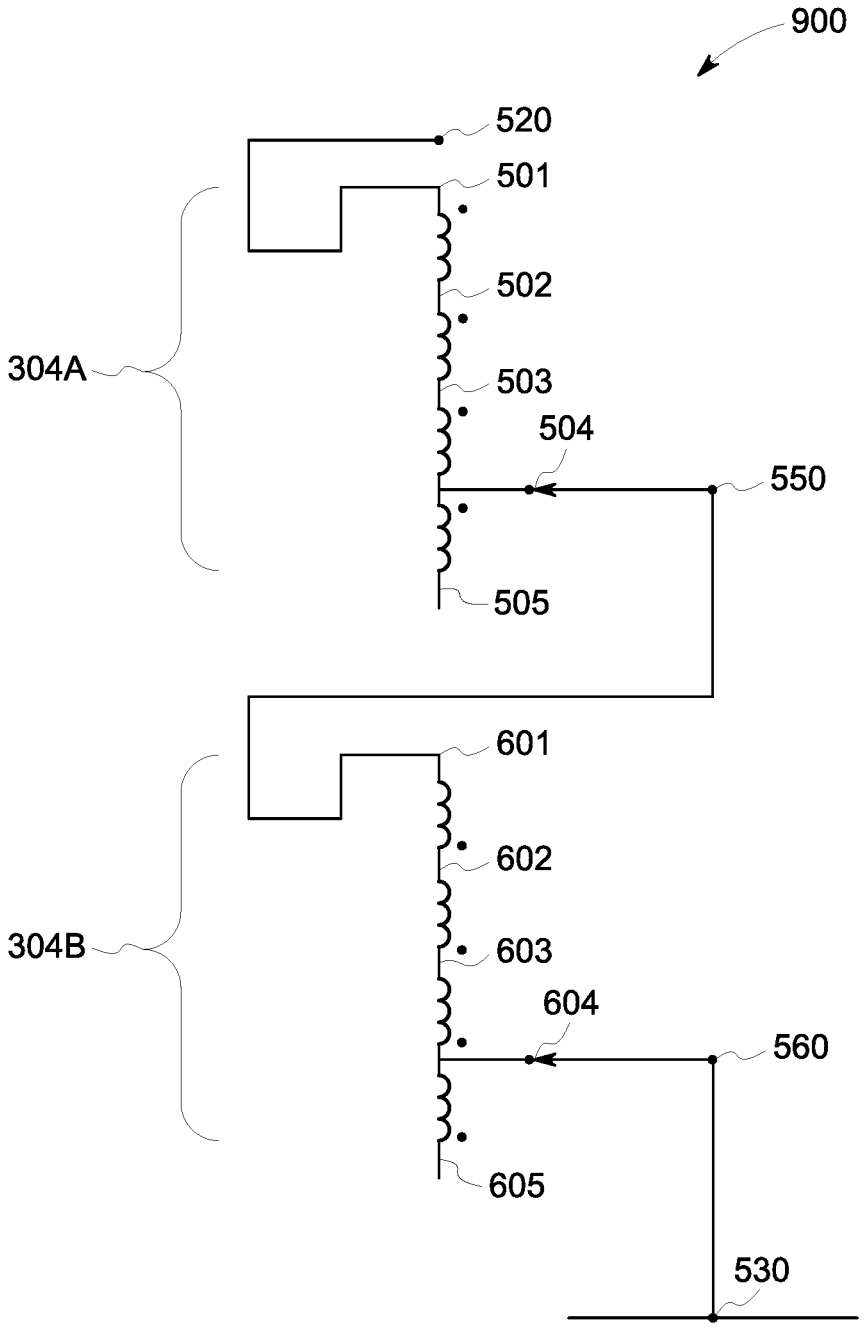
FIG. 9 illustrates a schematic representation of the circuitry of impedance-varying windings based on a fourth setting of a controller in accordance with one embodiment.

FIG. 9 illustrates a schematic representation of the circuitry of the impedance-varying windings 204 based on a fourth setting 900 of the impedance controller 126. The fourth setting 900 of the controller 126 illustrates the transformer phase 102 having an impedance that is greater than the impedance of the third setting 800, that is greater than the impedance of the second setting 700, and that is greater than the impedance of the first setting 600. For example, the fourth setting 900 of the impedance controller 126 electrically couples the first impedance tap changer 550 with a fourth even tap 504, and electrically couples the second impedance tap changer 560 with a fourth odd tap 604.

Figure 10:
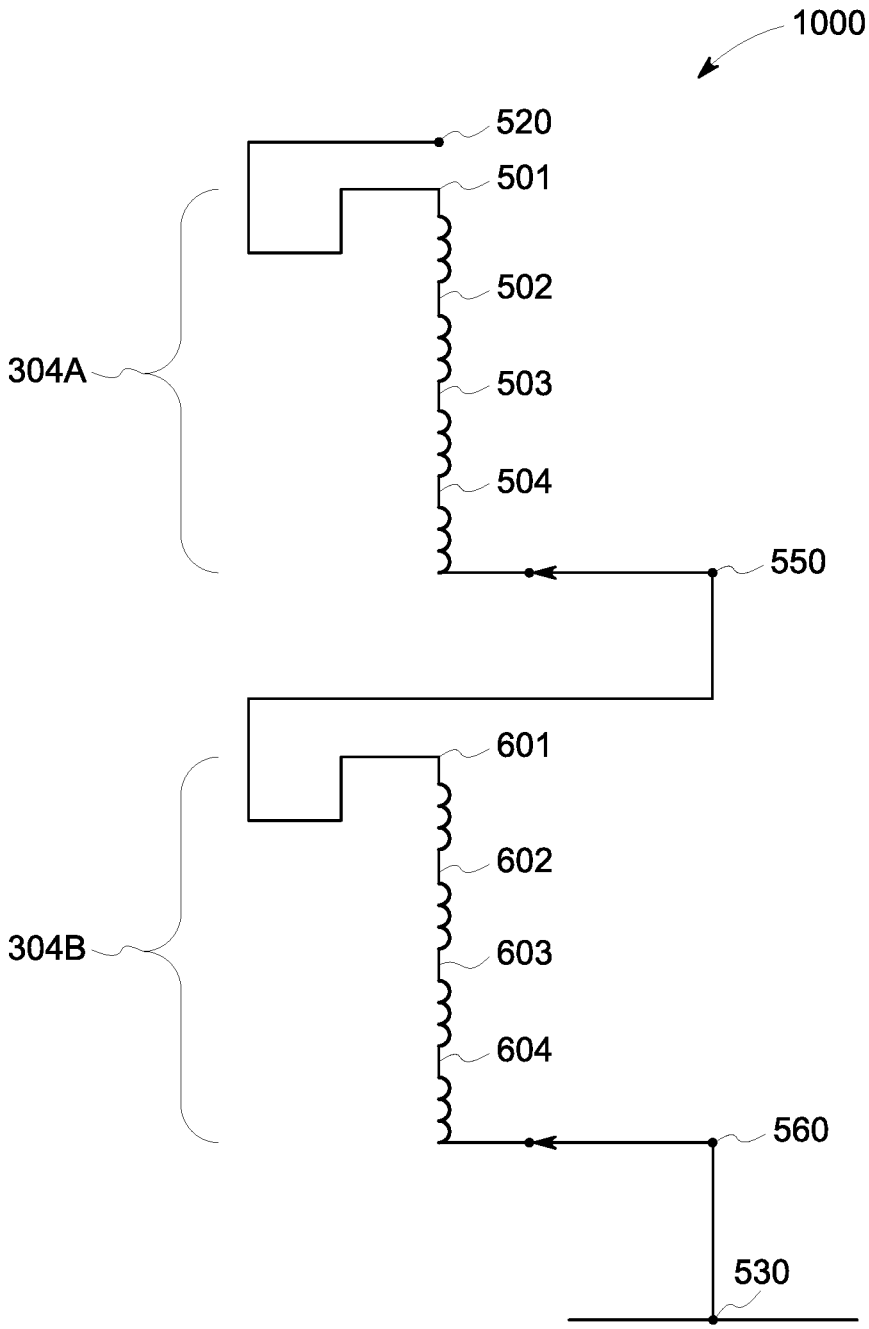
FIG. 10 illustrates a schematic representation of the circuitry of impedance-varying windings based on a fifth setting of a controller in accordance with one embodiment.

FIG. 10 illustrates a schematic representation of the circuitry of the impedance-varying windings 204 based on a fifth setting 1000 of the impedance controller 126. The fifth setting 1000 of the controller 126 may illustrate the transformer phase 102 having the greatest impedance. For example, the impedance of the fifth setting 1000 is greater than each of the impedance of the first, second, third, and forth settings 600, 700, 800, 900, respectively. For example, the fifth setting 1000 electrically couples the first impedance tap changer 550 with the fifth even tap 505, and electrically couples the second impedance tap changer 560 with the fifth odd tap 605.

FIGS. 6, 7, 8, 9, and 10 illustrate five examples of the variable transformer system 100 having four impedance-varying even coils and four impedance-varying odd coils and five odd and even taps, respectively, in order to change the impedance of the system 100. Optionally, the system 100 may have less than or more than five odd and even coils, and/or may have less than or more than five odd and even taps, in order to change the impedance of the system 100.

Returning to FIGS. 4 and 5, Winding 4 illustrates a multiturn coil that provides the voltage-varying windings 302 of the transformer phase 102. The voltage-varying windings 302 may be electrically coupled with a voltage tap changer 540 that may be controlled by manipulation of the voltage switch 124 (of FIG. 1B). For example, control or manipulation of the voltage switch 124 (of FIG. 1B) may change the voltage ratio (e.g., the voltage output) of the system 100 by changing which portion of the voltage-varying winding of the voltage-varying windings 302 are conductively coupled with the conductive windings 208A and which portion of the voltage-varying windings of the voltage-varying windings 302 are disconnected from the conductive windings 208A.

Similar to the impedance tap changers 550, 560, the voltage tap changer 540 may be controlled by the voltage switch 124 of the controller 116. By controlling the voltage switch 124, the voltage ratio of the system 100 may change by conductively decoupling a portion of the voltage-varying windings from the conductive windings 208A. For example, the voltage tap changer 540 may be electrically decoupled with and electrically coupled with different portions of the voltage-varying windings 302 via control of the voltage switch 124.

Additionally or alternatively, the voltage ratio of the system 100 may be changed by changing a direction of the current flow in the voltage-varying windings 302. For example, a switch 312 may change the direction of the current that flows in the voltage-varying windings 302. As illustrated in FIG. 5, the switch 312 may move to direct the current to flow from a positive side toward a negative side; or may direct the current to flow from the negative side toward the positive side. Changing the direction of the current flow in the voltage-varying windings 302 includes conductively coupling the voltage-varying windings 302 with the conductive windings 208A in a common direction when the current flows in the common direction. For example, the current may flow in a first direction in the conductive windings 208A and in the same first direction in the voltage-varying windings 302 such that the conductive windings 208A and the voltage-varying windings 302 have a common or same polarity.

Alternatively, the voltage-varying windings 302 may be conductively coupled with the conductive windings 208A in an opposite direction such that the current flows in the opposite direction. For example, the current may flow in a first direction in the conductive windings 208A, and may flow in a different, second direction in the voltage-varying windings 302 such that the conductive windings 208A and the voltage-varying windings 302 have an opposite polarity. Conductively coupling the voltage-varying windings 302 with the conductive windings 208A having the common polarity (e.g., current flows in a common direction) reduces the voltage ratio of the system relative to conductively coupling the voltage-varying windings 302 with the conductive windings 208A having opposite polarity (e.g., current flows in different directions). For example, the voltage-varying windings 302 having an opposite polarity that the conductive windings 208A increased the voltage ratio of the system 100.

Returning to FIGS. 4 and 5, Winding 5 illustrates a center-entry conductive windings 208B of the transformer phase 102. For example, the center-entry conductive windings 208B may be electrically coupled with the high voltage bushing end 104 of the system 100. Optionally, the center-entry conductive windings 208B may be electrically coupled with the low voltage bushing end 106 of the system 100. Winding 6 illustrates a disk-type conductive winding 314. The disk-type conductive windings 314 provide +/−2×2.5% off-circuit taps for the high-voltage circuit side of the transformer phase 102. Optionally, the circuit of the transformer phase 102 may not include the disk-type conductive windings 314. Additionally or alternatively, the disk-type conductive windings 314 may be integrated as part of a series winding of the circuit of the transformer phase 102.

Figure 11:
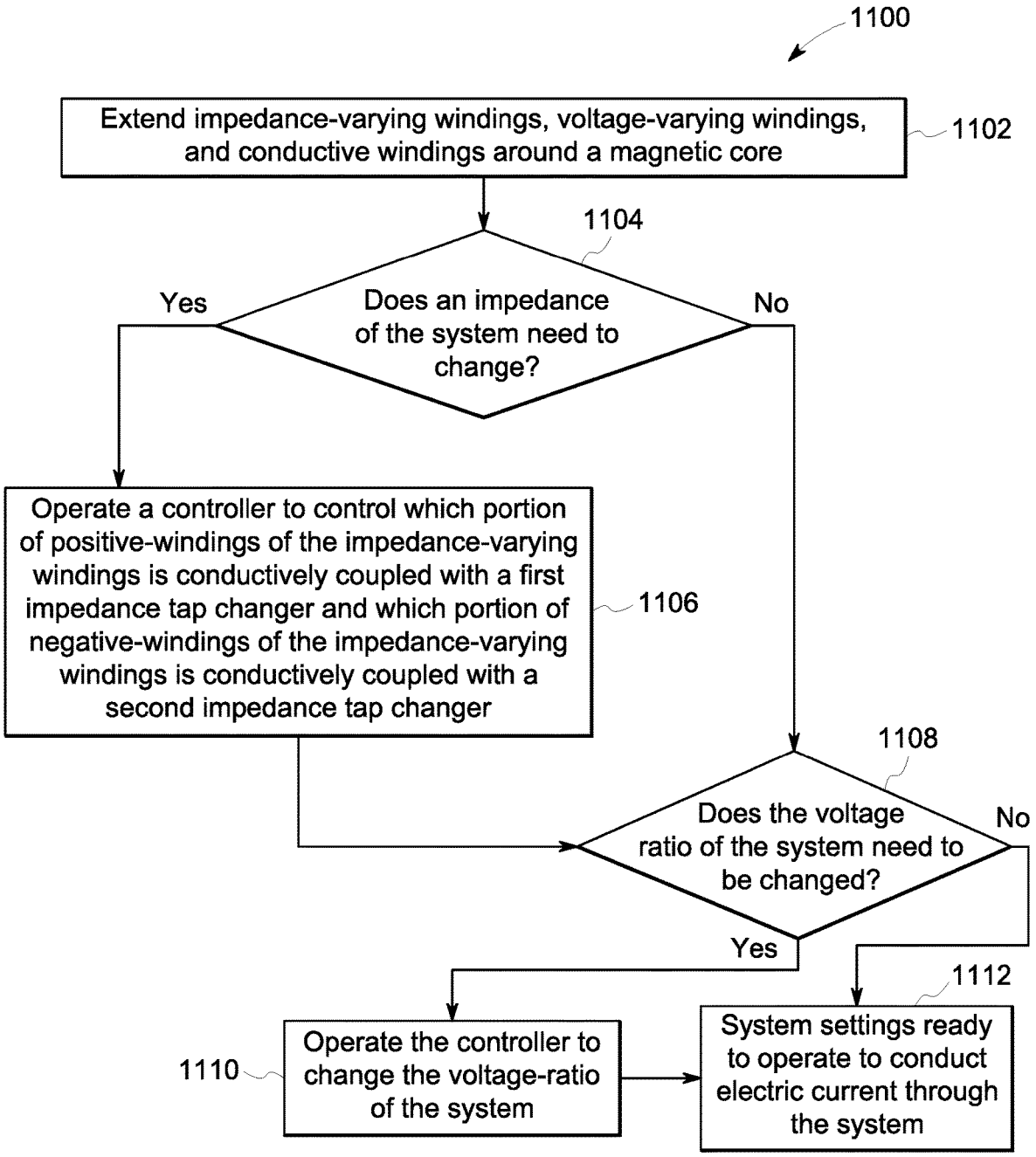
FIG. 11 illustrates a flowchart of a method of controlling a power level of a flexible transformer system in accordance with one embodiment.

FIG. 11 illustrates a flowchart 1100 of a method for controlling a power level of a flexible transformer system in accordance with one embodiment. For example, the method 1100 may include selecting the impedance and/or operating voltage class of the system 100. The system 100 may be a flexible large power transformer system, a flexible three-phase system, a flexible single-phase system, or the like. Optionally, the system 100 may be a single-phase flexible mobile power transformer system, a multi-phase flexible mobile power transformer system, or the like, when the system is used as a mobile transformer within mobile substations.

At 1102, conductive windings, impedance-varying windings, and voltage-varying windings are extended around a magnetic core of a transformer phase of a variable or flexible transformer system. The conductive windings may be electrically coupled with a high voltage bushing end and/or a low voltage bushing end of the transformer phase.

At 1104, a decision is made if the impedance of the system needs to be changed. As one example, the transformer phase may be a replacement transformer phase that may be installed within a transformer system. The system may have a current leakage impedance level, and the impedance of the replacement phase may need to substantially match the leakage impedance level of the system. As another example, the impedance may need to be changed in a one or more transformer phases of a multi-phase system to balance an amount of power configured to flow through each of the transformer phases of the multi-phase system. As another example, an amount of power that passes through the system may need to be changed (e.g., increased or decreased). Changing the impedance of the system changes the amount of power that passes through the system. As another example, a fault current level of the system may need to be changed. Changing the impedance of the system changes the fault current level of the amount of current that may be allowed to pass through the system. Optionally, the impedance of the system may need to be changed for any alternative purpose. If the impedance of the system does not need to change, then flow of the method proceeds toward 1108. If the impedance of the system does need to change, then flow of the method proceeds toward 1106.

At 1106, a controller is operated and/or manipulated, for example, by an operator at the system and/or by an operator remote from the system. Optionally, the controller may be automatically operated and/or manipulated by one or more processors of the controller based on one or more predetermined rules or guidelines for operating the system. Controlling the impedance controller changes which portion of positive windings a first impedance tap changer is electrically coupled with, and changes which portion of negative windings a second impedance tap changer is electrically coupled with. The first and second tap changers may be controlled to change the impedance of the system while the system is online, or operating. For example, the system may not need to be shut down and de-energized before the first and second tap changers change which positive and negative windings they are electrically coupled with, respectively. For example, the first tap changer and the second tap changer may be electrically coupled with first positive and negative windings. However, the impedance may need to be changed such that the first and second impedance tap changers may need to be electrically coupled with second positive and negative windings, respectively, of the impedance-varying windings. The controller may change the impedance by controlling the first and second impedance tap changers without first de-energizing and shutting down the system. For example, the system may continue to operate while the controller changes the impedance of the system by controlling the first and second impedance tap changers. Additionally, the impedance of the system may be changed without changing the voltage-ratio of the system.

In one or more embodiments, the impedance of a single phase of a three-phase large power transformer system may need to be changed. For example, the controller may change the impedance of one phase of the three-phase system, and may not change the impedance of the other phases of the system. Optionally, the impedance of every phase of the multi-phase system may need to be changed, and the controller may change the impedance of every phase of the multi-phase system.

At 1108, a decision is made if the voltage-ratio of the system needs to be changed. If the voltage-ratio does not need to be changed, then flow of the method may flow toward 1112. Alternatively, if the voltage-ratio does need to be changed, then flow of the method proceeds toward 1110.

At 1110, the voltage-ratio of the system is changed. In one or more embodiments, the voltage-ratio may be changed by conductively decoupling a portion of the voltage-varying windings from the conductive windings. For example, the controller may be operated and/or manipulated to control a voltage tap changer to change which portion of the voltage-varying windings is electrically coupled with the conductive windings. Additionally or alternatively, the voltage-ratio of the system may be changed by changing a direction of the current that flows in the voltage-varying windings. For example, the controller may be operated and/or manipulated to control a switch to change the direction of flow of current. The direction of flow of the current in the voltage-varying windings may be changed to flow in the same or common direction as the current that flows in the conductive windings. For example, the voltage-varying windings may have a common polarity as the conductive windings. Alternatively, the direction of flow of the current in the voltage-varying windings may be changed to flow in an opposite direction as the current that flows in the conductive windings. For example, the voltage-varying windings may have an opposite polarity as the conductive windings. Directing the current to flow in the common direction in the voltage-varying windings and the conductive windings reduces the voltage-ratio of the system relative to directing the current to flow in the opposite directions in the voltage-varying windings and the conductive windings.

At 1112, the settings of the transformer system (e.g., including the setting of each transformer phase) is complete. The system and each transformer phase may operate with a leakage reactance and voltage-ratio at which the impedance controller and the voltage switch have been set to. For example, the transformer phase may operate with a leakage reactance of about 10% and a voltage-ratio of about 345 kV/138 kV based on the settings of the first and second impedance tap changers, the voltage tap changer, and the switch controlling the direction of the current in the voltage-varying windings.

In one or more embodiments of the subject matter described herein, a system includes conductive windings extending around a magnetic core and impedance-varying windings extending around the magnetic core. The impedance-varying windings include positive windings and negative windings. The conductive windings and the impedance-varying windings conduct electric current around the magnetic core. The system includes a first impedance tap changer that is electrically coupled with the positive windings of the impedance-varying windings and a second impedance tap changer electrically coupled with the negative windings of the impedance-varying windings. A controller controls the first impedance tap changer and the second impedance tap changer to change an impedance of the system by changing which portion of the positive windings and which portion of the negative windings are conductively coupled with the conductive windings, and which portion of the positive windings and which portion of the negative windings are disconnected from the conductive windings.

Optionally, the controller may change the impedance of the system while the system is operating.

Optionally, the controller may change the impedance of the system to control one or more of an amount of power that passes through the system or amount of a fault current allowed to move through the system.

Optionally, the system is a flexible three-phase large power transformer or a flexible single-phase large power transformer.

Optionally, the controller may control the impedance of one or more transformer phases of the flexible three-phase large power transformer.

Optionally, the control may control the impedance of one or more transformer phases of the flexible three-phase large power transformer to balance an amount of power configured to flow through each of the one or more transformer phases.

Optionally, the controller may change the impedance of the system without changing a voltage ratio of the system.

Optionally, the system may include voltage-varying windings extending around the magnetic core. The voltage-varying windings may conduct electric current around the magnetic core.

Optionally, the system may include a voltage switch coupled with the voltage-varying windings. The voltage switch may change a voltage ratio of the system by one or more of conductively decoupling a portion of the voltage-varying windings from the conductive windings or changing a direction of the current flow in the voltage-varying windings.

Optionally, the voltage switch may change the voltage ratio of the system without changing the impedance of the system.

Optionally, changing the direction of the current flow in the voltage-varying windings may include conductively coupling the voltage-varying windings with the conductive windings in a common direction when the current flows in the common direction, or conductively coupling the voltage-varying windings with the conductive windings in an opposite direction when the current flows in the opposite direction.

Optionally, conductively coupling the voltage-varying windings with the conductive windings having a common polarity reduces the voltage ratio of the system, and conductively coupling the voltage-varying windings with the conductive windings having opposite polarity increases the voltage ratio of the system.

In one or more embodiments of the subject matter described herein, a method includes changing an impedance of a system that includes conductive windings and impedance-varying windings extending around a magnetic core by operating a controller coupled with the impedance-varying windings and the conductive windings. Operation of the controller controls which portion of positive windings of the impedance-varying windings is conductively coupled with a first impedance tap changer, and which portion of negative windings of the impedance-varying windings is conductively coupled with a second impedance tap changer.

Optionally, the method may include changing the impedance of the system while the system is operating.

Optionally, the method may include changing the impedance of the system to control one or more of an amount of power that passes through the system or a fault current level allowed to move through the system.

Optionally, the system may be a flexible three-phase large power transformer. The method may include controlling the impedance of one or more transformer phases of the flexible three-phase large power transformer.

Optionally, the system is a flexible three-phase large power transformer, and the method may include controlling the impedance of one or more transformer phases of the flexible three-phase large power transformer to balance an amount of power that may flow through each of the one or more transformer phases.

Optionally, the system may include voltage-varying windings extending around the magnetic core and conducting electric current around the magnetic core.

Optionally, the method may include changing a voltage ratio of the system by one or more of changing a direction of current flow in the voltage-varying windings by controlling a voltage switch coupled with the voltage-varying windings or conductively decoupling a portion of the voltage-varying windings from the conductive windings.

Optionally, changing the direction of the current flow in the voltage-varying windings may include conductively coupling the voltage-varying windings with the conductive windings in a common direction when the current flows in the common direction, or conductively coupling the voltage-varying windings with the conductive windings in an opposite direction when the current flows in the opposite direction.

Optionally, the method may include reducing the voltage ratio of the system by conductively coupling the voltage-varying windings with a portion of the conductive windings having a common polarity. The method may include increasing the voltage ratio of the system by conductively coupling the voltage-varying windings with a portion of the conductive windings having opposite polarity.

In one or more embodiments of the subject matter described herein, a system includes conductive windings, voltage-varying windings, and impedance-varying windings extending around a magnetic core. The impedance-varying windings include positive windings and negative windings. The conductive windings, the voltage-varying windings, and the impedance-varying windings conduct electric current around the magnetic core. The system includes a first impedance tap changer that is electrically coupled with the positive windings of the impedance-varying windings and a second impedance tap changer electrically coupled with the negative windings of the impedance-varying windings. A controller controls the first impedance tap changer and the second impedance tap changer to change an impedance of the system by changing which portion of the positive windings and which portion of the negative windings are conductively coupled with the conductive windings, and which portion of the positive windings and which portion of the negative windings are disconnected from the conductive windings. The controller changes a voltage ratio of the system by one or more of conductively decoupling the voltage-varying windings from the conductive windings or changing a direction of a current flow in the voltage-varying windings.

As used herein, an element or step recited in the singular and proceeded with the word "a" or "an" should be understood as not excluding plural of said elements or steps, unless such exclusion is explicitly stated. Furthermore, references to "one embodiment" of the presently described inventive subject matter are not intended to be interpreted as excluding the existence of additional embodiments that also incorporate the recited features. Moreover, unless explicitly stated to the contrary, embodiments "comprising," "including," or "having" (or like terms) an element, which has a particular property or a plurality of elements with a particular property, may include additional such elements that do not have the particular property.

As used herein, terms such as "system" or "controller" may include hardware and/or software that operate(s) to perform one or more functions. For example, a system or controller may include a computer processor or other logic-based device that performs operations based on instructions stored on a tangible and non-transitory computer readable storage medium, such as a computer memory. Alternatively, a system or controller may include a hard-wired device that performs operations based on hard-wired logic of the device. The systems and controllers shown in the figures may represent the hardware that operates based on software or hardwired instructions, the software that directs hardware to perform the operations, or a combination thereof.

As used herein, terms such as "operably connected," "operatively connected," "operably coupled," "operatively coupled" and the like indicate that two or more components are connected in a manner that enables or allows at least one of the components to carry out a designated function. For example, when two or more components are operably connected, one or more connections (electrical and/or wireless connections) may exist that allow the components to communicate with each other, that allow one component to control another component, that allow each component to control the other component, and/or that enable at least one of the components to operate in a designated manner.

It is to be understood that the subject matter described herein is not limited in its application to the details of construction and the arrangement of elements set forth in the description herein or illustrated in the drawings hereof. The subject matter described herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the presently described subject matter without departing from its scope. While the dimensions, types of materials and coatings described herein are intended to define the parameters of the disclosed subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method comprising:

changing an impedance of a system that includes conductive windings and impedance-varying windings extending around a magnetic core by operating a controller coupled with the impedance-varying windings and the conductive windings to simultaneously control which portion of positive windings of the impedance-varying windings is conductively coupled with a first impedance tap changer and which portion of negative windings of the impedance-varying windings is conductively coupled with a second impedance tap changer, wherein the impedance of the system is changed to a desired impedance value.

2. The method of claim 1, further comprising changing the impedance of the system while the system is operating.

3. The method of claim 1, further comprising changing the impedance of the system to control one or more of an amount of power that passes through the system or a fault current level allowed to move through the system.

4. The method of claim 1, wherein the system is a three-phase power transformer, and further comprising controlling the impedance of one or more transformer phases of the three-phase power transformer.

5. The method of claim 1, wherein the system is a three-phase power transformer, and further comprising controlling the impedance of one or more transformer phases of the three-phase power transformer to balance an amount of power configured to flow through each of the one or more transformer phases.

6. The method of claim 1, wherein the system includes voltage-varying windings extending around the magnetic core, the voltage-varying windings also configured to conduct electric current around the magnetic core, and further comprising changing a voltage ratio of the system by one or more of changing a direction of current flow in the voltage-varying windings by controlling a voltage switch coupled with the voltage-varying windings or conductively decoupling a portion of the voltage-varying windings from the conductive windings.

7. The system of claim 6, wherein changing the direction of the current flow the voltage-varying windings includes conductively coupling the voltage-varying windings with the conductive windings in a common direction when the current flows in the common direction, or conductively coupling the voltage-varying windings with the conductive windings in an opposite direction when the current flows in the opposite direction.

8. The system of claim 6, further comprising reducing the voltage ratio of the system by conductively coupling the voltage-varying windings with a portion of the conductive windings having a common polarity, and further comprising increasing the voltage ratio of the system by conductively coupling the voltage-varying windings with a portion of the conductive windings having opposite polarity.

* * * * *